US006112488A

United States Patent [19]

Olson et al.

[11] Patent Number: 6,112,488

[45] Date of Patent: Sep. 5, 2000

[54] FIRE BARRIER MATERIAL AND GASKETS THEREFOR

[75] Inventors: James R. Olson, Youngstown; Lee A. Peekstock, Sanborn; Kevin D. Packard, Grand Island; Sarah E. Brewer, Buffalo, all of N.Y.

[73] Assignee: Unifrax Corporation, Niagara Falls, N.Y.

[21] Appl. No.: 08/840,670

[22] Filed: Apr. 29, 1997

[51] Int. Cl.[7] ..... E04B 1/62

[52] U.S. Cl. ..... 52/393; 52/396.01; 52/573.1; 52/232; 52/317; 52/167.1

[58] Field of Search ..... 52/393, 394, 395, 52/396.01, 396.04, 396.08, 396.09, 232, DIG. 7, 1, 573.1, 317, 167.1

[56] References Cited

U.S. PATENT DOCUMENTS

| | | | |
|---|---|---|---|
| 4,048,363 | 9/1977 | Langer et al. . | |
| 4,509,559 | 4/1985 | Cheetham et al. . | |
| 4,566,242 | 1/1986 | Dunsworth | 52/396.01 |
| 4,811,529 | 3/1989 | Harris et al. | 52/396.01 |
| 4,894,966 | 1/1990 | Bailey et al. . | |
| 4,931,339 | 6/1990 | Malcolm-Brown . | |
| 4,999,962 | 3/1991 | Gohlke et al. . | |
| 5,103,609 | 4/1992 | Thoreson et al. . | |
| 5,326,609 | 7/1994 | Gohlke . | |
| 5,461,838 | 10/1995 | Heller | 52/396.01 |
| 5,681,640 | 10/1997 | Kiser . | |
| 5,765,332 | 6/1998 | Landin et al. . | |
| 5,974,750 | 11/1999 | Landin et al. . | |

FOREIGN PATENT DOCUMENTS

0501271 A2 9/1991 European Pat. Off. .

OTHER PUBLICATIONS

Hawley's Condensed Chemical Dictionary, Eleventh Edition, page 641, Dec. 1987.

Ul 2079 Standard for "Tests of Fire Resistance of Building Joint Systems", Third Edition, Jul. 31, 1998.

*Primary Examiner*—Carl D. Friedman
*Assistant Examiner*—Dennis L. Dorsey
*Attorney, Agent, or Firm*—Renner, Kenner, Greive, Bobak, Taylor & Weber

[57] ABSTRACT

A fire resistant gasket for architectural joints comprises an intumescent material mat having a first major surface and a second major surface, wherein at least one of said first and second major surfaces has coated thereon an adhesive. A fire barrier is provided comprising: at least one fire resistant intumescent gasket material having a first major surface and a second major surface, wherein at least one of said first and second major surfaces has coated thereon an adhesive, and at least one fire resistant material barrier layer bonded to a portion of one of said first and second major surface, preferably adhered to a portion of said adhesive coated gasket surface. A process for installing a building joint fire barrier comprises providing at least one fire resistant intumescent gasket material having a first major surface and a second major surface, wherein at least one of said first and second major surfaces has coated thereon an adhesive, adhering the gasket material to at least one of a building member and a fire resistant material barrier layer, and affixing the fire resistant material barrier layer to the building member with the gasket material interposed therebetween.

19 Claims, 1 Drawing Sheet

FIRE BARRIER MATERIAL AND GASKETS THEREFOR

TECHNICAL FIELD

The present invention is directed to a fire barrier for use in building construction. In particular, the present invention is directed to a fire barrier material used in conjunction with wall, ceiling or floor expansion joint systems to aide in the substantial reduction of the chimney effect associated with buildings having these types of expansion joints.

BACKGROUND OF THE INVENTION

Architects and engineers must take into account the effects not only of seismic movement, but also those movements caused by building sway, settlement, thermal expansion and contraction. Architects know that any building that may be subjected to ground oscillations must be designed to control and accommodate movement caused by resonation within the structure while additionally providing for tower sway, thermal movement and settlement.

Buildings have been designed with various expansion joints between the walls, ceilings and floors to take into account the sway, ground motion, settlement, etc. associated with buildings. However, a disadvantage of the use of expansion joints is that they create a chimney effect in the building structure. Because fire is an everpresent danger in association with any building and the chimney effect at unprotected expansion joints may actually advance a spread, it is highly desirable to utilize a fire barrier in conjunction with any expansion joint assembly to provide additional protection to aid in the prevention of the spreading of any fire.

Fire barriers are often comprised of a suitable fire retardant material reinforced with wire mesh and/or foils. This metal reinforcement is positioned between the joint prior to the application of the expansion joint assembly. The fire barrier is a highly thermal resistant material which protects the joint from the associated chimney effect within the building construction.

Other types of joint treatment systems have included insulated metal foil (i.e. aluminum) layers such as those disclosed in the Fire Resistant Directory, pages 718–721 and 821–823. While these fire resistant barrier layers are suitable for reduction in the chimney effect associated with buildings containing expansion joints, they clearly can be improved. For example, these barrier structures are difficult to install and difficult to handle and ship.

Fire barrier devices have also been designed that comprise flexible, composite barriers including a laminate of intumescent material and a backing material, such as metal foils or sheets, paper, plastic, cloth, or a mat of inorganic fibers in a binder. When exposed to heat or fire, the intumescent materials expand so as the fill open spaces in the vicinity of the architectural joint to prevent the passage of smoke, fire, water or gas.

These systems have conventionally been required to be affixed to the structural joint members by fire resistant caulk compositions. During installation of the fire barrier, a caulking is applied to the edges of the barrier to provide a seal to the structural building elements.

These systems are recognized in the industry as being messy and difficult to install. Further, great care must be taken to assure that the caulk bead is of sufficient quality and quantity to hold the fire barrier and to provide the seal. Due to the nuisance caused by these installation difficulties, the integrity of these systems may be compromised by worker frustration.

A further drawback of the caulk adhered systems is the physical rigidity or inflexibility of the caulk material, and its low tolerance for compensating for building movement. In both fire testing and real life cycling of fire barriers affixed with caulk, both the caulk and the integrity of the barrier are significantly compromised. This is recognized by the fact that the U.L. Standard for Tests For Fire Resistance of Building Joint Systems (UL2079), which requires cycling of the building joint systems for a minimum of twenty complete movement cycles prior to the fire test, waives the cycling requirement for the caulk adhered fire barrier systems. The caulk adhered systems are thus "like new" when tested, unlike other systems which must be cycled and "conditioned" (or aged).

SUMMARY OF THE INVENTION

It is an object of the present invention to provide a novel gasket material for fire barriers used in building construction which is easily handled and shipped.

It is another object of the present invention to provide a gasket material for fire barriers having effective fire resistant and capable of being easily installed.

Additional objects and advantages of the invention are set forth in the description of the invention which follows. The objects and advantages of the invention may be realized and attained by means of the instrumentalities and combinations particularly pointed out in the appended claims.

The present invention is directed to a fire barrier gasket material which can be easily handled and installed. The installation is simplified due to the integral incorporation of the barrier into the joint design by use of a peel and stick gasket product. The quality and quantity of joint sealing material is assured by use of the fire barrier of the present invention. During fire exposure, the fire barrier with the gasket of the present invention provides expansion of material into void spaces in the vicinity of the joint, assuring a complete and effective seal.

To achieve the foregoing objects and in accordance with the purpose of the invention as embodied and broadly described herein the fire resistant gasket of this invention comprises an intumescent material mat having a first major surface and a second major surface, wherein at least one of said first and second major surfaces has coated thereon an adhesive.

In one embodiment, the present invention provides a fire resistant intumescent gasket for architectural joints comprising an intumescent mat material having a first major surface and a second major surface, wherein at least one of said first and second major surfaces has coated thereon an adhesive, and wherein in one embodiment, a release layer contacts the adhesive opposite said gasket surface.

In one embodiment, the first barrier of the present invention comprises:

at least one fire resistant intumescent gasket material having a first major surface and a second major surface, wherein at least one of said first and second major surfaces has coated thereon an adhesive, and at least one fire resistant material barrier layer bonded or adhered to a portion of one of said first and second major surfaces, preferably to said adhesive coated gasket surface.

In a further embodiment, a fire resistant intumescent gasket material according to the present invention is adhered via the coated adhesive to opposite ends of the fire resistant material barrier layer. The fire resistant material barrier layer may comprise a laminate of a metal layer, such as a foil, screen or mesh and at least one integral gas barrier layer. In a preferred embodiment, the laminate includes at least one intumescent layer, and optionally a layer of ceramic fiber paper.

In one preferred embodiment, the fire resistant layer comprises a metal screen, foil or mesh reinforcement layer contacting the intumescent gasket, an outer intumescent material layer on the surface of the metal layer opposite the gasket-contacting surface, and an inner intumescent material layer contacting the outer intumescent material layer opposite the metal layer.

DETAILED DESCRIPTION OF THE INVENTION

Figure 1:
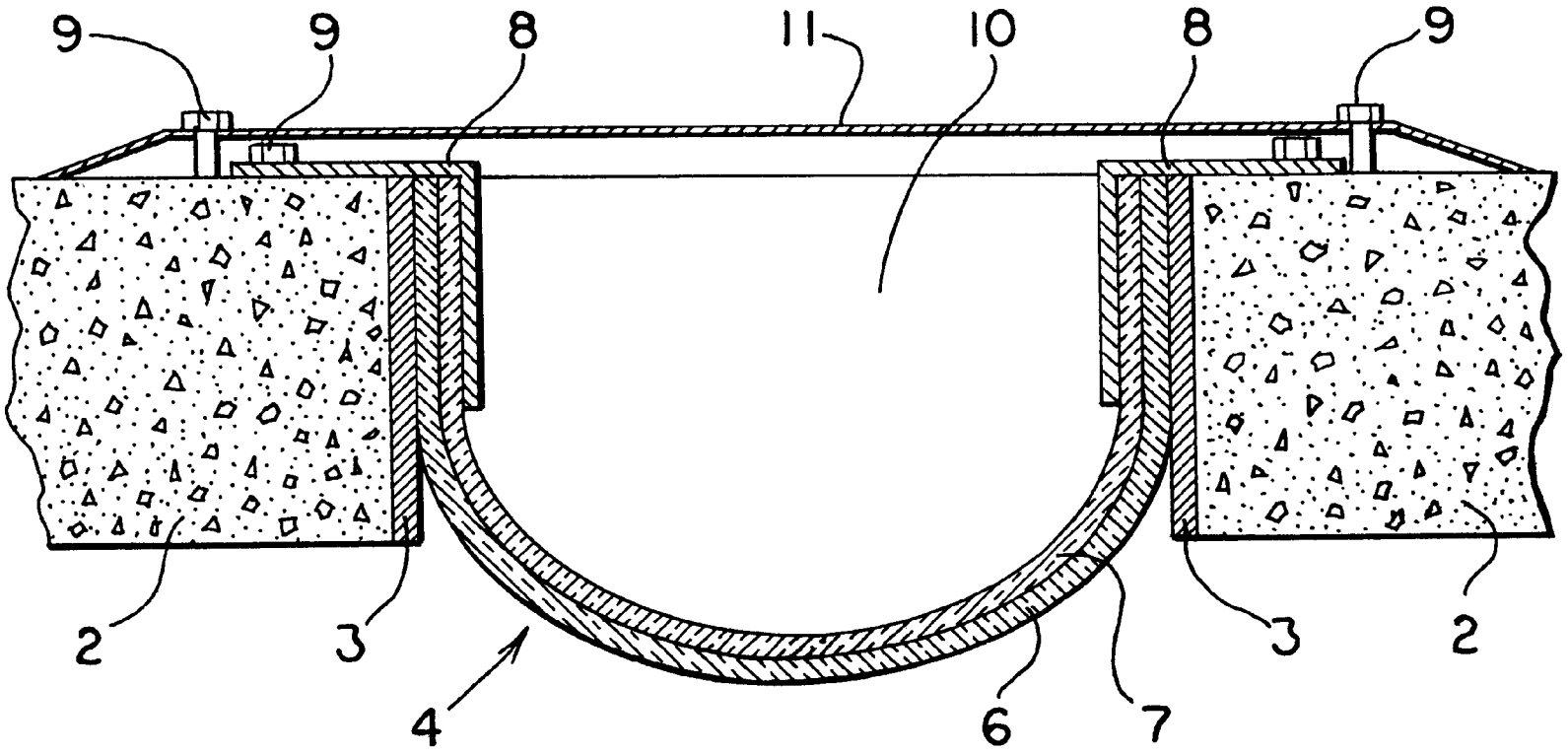

While the invention will be described in connection with the preferred embodiments, it should be understood that this description is not intended to limit the invention to that particular embodiment. On the contrary, it is intended to cover all alternatives, modifications and equivalents as may be included within the spirit and scope of the invention as defined in the appended claims.

The present invention includes a fire resistant intumescent gasket material for sealing the edges of fire barriers for architectural joints. The fire resistant intumescent gasket material has a first major surface and a second major surface, wherein at least one of said first and second major surfaces has coated thereon an adhesive. Preferably, a release layer, that is, a release film or paper containing a release layer, contacts the adhesive opposite the gasket surface.

The intumescent gasket may be fabricated conventionally in jumbo rolls, similarly to intumescent mats conventionally used for fire protection applications. According to the present invention, a double coated adhesive and a release paper may be applied to the intumescent mat through a conventional lamination process. This material can then be slit or die cut to appropriate sizes for fire barrier construction.

The cut intumescent gasket pieces can be applied to the fire barrier material in the field, or preferably may be pre-applied as part of the factory assembly and shipped as an integral unit, bonded or adhered to the fire barrier. For example, the intumescent gasket can be bonded by stitches, staples, rivets, adhesive tabs or tape, glue or adhesive, or similar, conventional means for fastening.

The fire barrier can affixed to the architectural joint by selecting an appropriately sized piece for the joint elements to be protected, removing the release paper from the adhesive layer, and pressing the gasket/fire barrier assembly into place on the joint. In an embodiment in which only one surface of the gasket material has a coated adhesive, the gasket can be adhered to either the building member or the fire barrier material, such as by the peel and stick technique described above, or by applying the adhesive in the field.

Once affixed, the adhesive is of sufficient quality to keep the gasket material in place during shipping of the fire barrier and field installation of the assembled joint. While the intumescent gasket may contain an adhesive coating on the surface opposite the fire barrier to adhere it to the structural joint member, it is sufficient that it be adhesively jointed to the fire barrier in order to provide an effective seal once it is permanently affixed to the structural joint.

The function of the adhesive is to hold the gasket and or gasket/fire barrier assembly in place during the installation of the architectural joint, to prevent it from falling out during installation. Once the installation is completed, the building joint itself holds the gasket and fire barrier assembly in place, such as with bolts, barbs, clamps, and similar conventional means for fastening. Similarly, compression of the joint construction holds the gasket and fire barrier material in place after installation, and the adhesive function is not required for structural considerations.

With reference to FIG. 1, a U.L. test configuration for an architectural joint protected according to the present invention includes spaced apart structural elements 2 such as concrete slabs, to which are affixed fire resistant gaskets 3 of the present invention, by means of the coated adhesive on the surface of the gasket material opposite the fire barrier material 4. The fire barrier material 4 is affixed to the gaskets 3, preferably by means of an adhesive.

The fire barrier material preferably includes a laminate of a metal foil, screen or mesh (not shown), such as stainless steel, copper or aluminum, and an integral gas layer which may comprise an outer layer 6 of intumescent material, and an inner layer 7 of intumescent material. In other embodiments, the outer and/or inner layer may comprise a ceramic paper comprising ceramic fibers and an organic or inorganic binder.

The fire barrier material is not pulled taughtly, but contains slack to allow for movement perpendicular to the lengthwise direction of the joints. The fire barrier is further mechanically affixed to the structural members. The mechanical attachment may be by means of galvanized angle irons 8, optionally bolted to the members to form a permanent, immovable attachment, such as with masonry anchors 9, or in some instances, may provide for movement of one or more sides in the lengthwise (lateral) direction of the joint. The gasket material of the present invention therefore accomodates the normal cycling movement of architectural structures, unlike the rigid caulk material.

The void space 10 between the structural members and the fire barrier may be filled with insulation, such as fiberglass, and may be covered over by an architectural expansion joint cover 11. The architectural joint is therefore completely sealed by the intumescent sheet gasketted fire barrier, without requiring fire resistant caulking. It should be noted that, in the "green" state, or before exposure to fire, the gasket is not required to form an air-tight seal. However, the gasket expands upon heating and exposure to fire, forming a complete and effective seal of the building joint, to prevent fire and smoke from traversing the joint.

The intumescent material used for the fire resistant gasket and/or for the integral fire barrier layer may comprise an intumescent sheet material produced from unexpanded vermiculite, hydrobiotite, or water-swelling tetrasilicic flourine mica using organic or inorganic binders to provide a desirable degree of strength. The sheet material can be produced by standard paper-making techniques as described, for example, in U.S. Pat. No. 3,458,329, the disclosure of which is incorporated by reference. Examples of suitable intumescent sheet materials are disclosed in U.S. Pat. Nos. 3,916,057 and 4,305,992, the disclosures of which are incorporated Alternatively, the intumescent material may comprise a mixture of unexpanded vermiculite and expandable graphite in a relative amount of about 9:1 to about 1:2 vermiculite:graphite, as described in U.S. Pat. No. 5,384,188, the disclosure of which is incorporated by reference.

Preferably, the intumescent material comprises a composite blend of ceramic fibers, unexpanded vermiculite, and an organic binder system. Such a material, including Fiberfax® alumin-silica ceramic fibers, is available from Unifrax Corporation (Niagara Falls, N.Y.) under the XFP Expanding Fyre Paper trademark. The high temperature resistant ceramic fibers in the intumescent mat allows the gasket and fire barrier to withstand temperatures up to 2300° F. A representative formulation for such a preferred intumescent gasket and/or fire barrier material includes about 30 to about 45 weight percent ceramic fibers (preferably alumina-silica), about 45 to about 60 weight percent unexpanded vermiculite, and about 5 to about 10 weight percent organic binder.

When used as the integral fire barrier material, the intumescent paper optionally has a metal foil backing, such as stainless steel, copper or aluminum.

The intumescent material, described above, expands up to three times its thickness when exposed to temperatures above 620° F. In the event of a fire, the intumescent material expands to fill joints and voids to prevent the spread of flames and heat through the barrier-joint edge area.

According to the present invention, the fire resistant intumescent gasket possesses excellent handling properties, and effectively resists flexural damage and compressive deformation in service. This permits the gasket to be utilized in joint applications that undergo mechanical or thermal cycling.

In the fire barrier assembly described above, the optional ceramic fiber paper layer may comprise alumina-silica glassy fiber and shot, together with an orgnaic binder. Alumina-silica ceramic fiber paper having a 70/30 fiber/shot ratio and containing about 7 weight percent organic binder is available under the tradename Fiberfrax® paper from Unifrax Corporation (Niagara Falls, N.Y.), as well as a higher temperature resistant ceramic fiber paper produced from Fibermax® polycrystalline mullite ceramic fibers. Other suitable fire barrier papers may comprise heat resistant Insulfrax® glass fibers, also available from Unifrax Corporation, or fiberglass.

The adhesive which is applied to the intumescent material to form the gasket attachment may comprise a pressure sensitive rubber based adhesive, such as Adchem 3175M or Adchem 262M available from Adchem Corporation, Westbury, N.Y., double coated films, or a variety of rubber based hot melt adhesives available from H. B. Fuller, Vadnais Heights, Minn. Other forms of adhesive include hot melt glue, sprayed on in the field, such as a sprayable rubber cement. The release layer may be carried on a film, including paper, or a thermoplastic or thermoset polymeric film, with Mylar polyester film (DuPont) being preferred.

EXPERIMENTAL

A fire barrier test was conducted using a UL approved caulk to seal the edges of a fire barrier to a concrete floor test apparatus. The fire barrier lasted only 91 minutes, due to an inadequate edge seal which caused a direct heat path to the top surface of the fire barrier.

Two identical fire barrier were then tested, comprising a conventional UL listed 2 hour floor joint sold by Construction Specialties under the tradename FB 83. The fire barrier was designed to achieve a two hour test rating when exposed to the E-119 fire curve in a standard UL large scale test. One of the fire barriers was affixed to the concrete with the UL approved silicone caulk, and the other with an intumescent gasket adhesively attached to the fire barrier according to the present invention. In both cases, fiberglass packing was disposed between the fire barrier and the joint cover plate.

Little or no expansion of the silicone caulk occurred when exposed to the fire. The caulk adhered fire barrier experienced a failure time of 143 minutes at a maximum cold face temperature of 393° F. The caulk lost its strength during the fire, and did not remain in place after the fire test.

The fire barrier, adhesively sealed with the intumescent gasket according to the present invention, expanded significantly to fill the the gap between the fire barrier and the edge of the concrete slab. The inventive gasket provided a seal at the bottom of the fire barrier drape to cut off heat farther away from the cover plate. This system experienced failure at 147 minutes at a maximum cold face temperature of 390° F.

It should be understood that this test was conducted with the silicone caulk having been applied prior to the fire test, and without the cycling portion of the UL2079 test. The test results show that the inventive system is equivalent in fire resistance performance to a freshly installed caulk-sealed fire barrier system. The flexible gasket of the present invention does not exhibit failure at the edge seal, as does the conventional caulk system, however, and performs as well after thermal or mechanical cycling which would compromise the edge seal in a conventional caulk system.

It is thus demonstrated that the flexible, intumescent gasket of the present invention achieves the objects of the invention. Thus, the objects of the invention are accomplished by the present invention, which is not limited to the specific embodiments described above, but which includes variations modifications and equivalent embodiments defined by the following claims.

We claim:

1. A fire barrier comprising:

at least one fire resistant intumescent gasket material capable of expanding upon heating having a first major surface and a second major surface, wherein one of said first and second major surfaces is attached to a fire resistant material barrier layer, wherein another one of said first and second major surfaces is adapted for attachment to a building joint member, wherein at least one of said first and second major surfaces has coated thereon an adhesive, and at least one fire resistant material barrier layer is bonded to a portion of one of said first and second major surfaces of said gasket, and wherein the intumescent gasket material contains intumescent material selected from the group consisting of unexpanded vermiculite, hydrobiotite, water swelling tetrasilicic fluorine mica, expandable graphite, and mixtures thereof.

2. The fire barrier of claim 1 wherein the fire resistant intumescent gasket material barrier layer is adhered to a portion of said adhesive coated gasket surface.

3. The fire barrier of claim 1 wherein the fire resistant intumescent gasket material is adhered via the coated adhesive to opposite ends of the fire resistant material barrier layer.

4. The fire barrier of claim 1 wherein the fire resistant material barrier layer includes at least one intumescent layer.

5. The fire barrier of claim 1 wherein the fire resistant material barrier layer comprises a laminate of a metal layer and at least one integral gas barrier layer.

6. The fire barrier of any one of claims 1 through 5 wherein the fire resistant material barrier layer includes a layer of ceramic fiber paper.

7. The fire barrier of any one of claims 1 through 5 wherein the fire resistant material barrier layer includes a layer of high temperature resistant glass fiber paper.

8. The fire barrier of any one of claims 1 through 5 wherein the fire resistant barrier layer comprises at least one mat containing ceramic fibers, unexpanded vermiculite, and organic binder.

9. The fire barrier of any one of claims 1 through 5 wherein the fire resistant barrier layer comprises at least one mat containing about 30 to about 45 weight percent ceramic fibers, about 45 to about 60 weight percent unexpanded vermiculite, and about 5 to about 10 weight percent organic binder.

10. The fire barrier of claim 1 wherein the fire resistant material barrier layer comprises a metal screen or mesh layer contacting the intumescent gasket, an outer intumescent material layer on the surface of the metal layer opposite the gasket-contacting surface, and an inner intumescent material layer contacting the outer intumescent material layer opposite the metal layer.

11. The fire barrier of claim 1 wherein the fire resistant material barrier layer contains a metal foil backing.

12. The fire barrier of any one of claims 5, 10 or 11 wherein the metal is selected from stainless steel, copper and aluminum.

13. The fire barrier of claim 5 wherein the fire resistant material barrier layer includes at least one intumescent layer.

14. The fire barrier of claim 6 wherein the ceramic fibers comprise at least one of alumina-silica fibers polycrystalline mullite ceramic fibers.

15. A process for installing a building joint fire barrier comprising:

providing at least one fire resistant intumescent gasket material capable of expanding upon heating having a first major surface and a second major surface, wherein one of said first and second major surfaces is adapted for attachment to a building joint member, wherein another one of said first and second major surfaces is adapted for attachment to a fire resistant material barrier layer, and wherein at least one of said first and second major surfaces has coated thereon an adhesive, adhering the gasket material to at least one of a building member and a fire resistant material barrier layer, affixing the fire resistant material barrier layer to the building member with the gasket material interposed therebetween and fastened to said building member and fire resistant material barrier layer, wherein the intumescent gasket material contains intumescent material selected from the group consisting of unexpanded vermiculite, hydrobiotite, water swelling tetrasilicic fluorine mica, expandable graphite, and mixtures thereof.

16. The process of claim 15 wherein the gasket material provided has a release film contacting the adhesive opposite the gasket material, and wherein the release layer is removed prior to adhering the gasket material.

17. The process of claim 15, wherein the adhesive is applied to the gasket material just prior to adhering the gasket material.

18. The process of claim 15, wherein the gasket material is adhered to the fire resistant material barrier layer prior to the step of affixing.

19. The process of claim 18 wherein the gasket material is provided adhered to the fire resistant material barrier layer in an integral unit.

* * * * *